US009147327B2

(12) United States Patent
Breier

(10) Patent No.: US 9,147,327 B2
(45) Date of Patent: Sep. 29, 2015

(54) MULTI-FUNCTIONAL EMERGENCY DEVICE

(76) Inventor: Jeffrey A. Breier, Calexico, CA (US)

( * ) Notice: Subject to any disclaimer, the term of this patent is extended or adjusted under 35 U.S.C. 154(b) by 80 days.

(21) Appl. No.: 12/214,706

(22) Filed: Jun. 19, 2008

(65) Prior Publication Data

US 2009/0066504 A1 Mar. 12, 2009

Related U.S. Application Data

(60) Provisional application No. 60/945,066, filed on Jun. 19, 2007.

(51) Int. Cl.
*G08B 1/08* (2006.01)
*G08B 5/00* (2006.01)

(52) U.S. Cl.
CPC ..... *G08B 5/002* (2013.01)

(58) Field of Classification Search
CPC ..... G08B 5/002; G08B 5/36; G05D 1/0234
USPC ..... 340/539.13, 983, 321, 331, 825.49, 340/953; 116/202, 209
See application file for complete search history.

(56) References Cited

U.S. PATENT DOCUMENTS

| | | | | |
|---|---|---|---|---|
| 5,804,829 | A * | 9/1998 | Palmer | 250/504 H |
| 6,069,557 | A * | 5/2000 | Anglin et al. | 340/321 |
| 6,206,541 | B1 * | 3/2001 | Landamia | 362/184 |
| 2004/0113817 | A1 * | 6/2004 | Novak et al. | 340/983 |
| 2008/0001743 | A1 * | 1/2008 | Gallagher | 340/571 |

* cited by examiner

*Primary Examiner* — Phung Nguyen
(74) *Attorney, Agent, or Firm* — Donn K. Harms

(57) ABSTRACT

A multi-function emergency device combining a flashlight mounted on a housing with one or a plurality of beacons. A terrestrial location of the device is determinable by GPS or cellular triangulation. A first beacon employs visible light for responders to follow to the terrestrial location while a second beacon employs invisible light to transmit a secret beacon that cannot be seen without the aid of a viewer. A message may be encoded into the second beacon and deciphered.

12 Claims, 2 Drawing Sheets

MULTI-FUNCTIONAL EMERGENCY DEVICE

This application claims priority from U.S. Provisional Patent Application Ser. No. 60/945,066 filed Jun. 19, 2007 incorporated herein in its entirety by reference.

FIELD OF THE INVENTION

The disclosed device relates to a combination flashlight and location beacon. More particularly it relates to an emergency flashlight that also provides a beacon for guiding or communicating with response personnel using infrared or radio transmissions which may be detected and/or monitored for communications.

BACKGROUND OF THE INVENTION

In the field of law enforcement, security, fire protection and the military, individuals are commonly dispatched in vehicles to remote sites to carry out specific tasks. Too often these tasks are hazardous to those individuals causing injury or an immediate need for back up assistance. However, in some cases they are not capable of relaying their physical condition or location instantaneously. Additionally if an individual is incapacitated and not capable of providing their location to responding personnel for any unforeseen reason and direct radio communication cannot be made, it is very difficult and often dangerous for responding back-up personnel to locate them, especially at night or extreme confrontational circumstances. In cases where an individual is involved in extreme physical activity there is no capability for the dispatcher to determine or monitor their physical condition, their specific location or if they have suffered an injury or a firearm has been discharged.

BACKGROUND OF THE INVENTION

In emergencies and during natural disasters and the like, power from the grid is frequently interrupted as is phone service. Additionally, personnel such as police and firemen who respond to emergencies and police incidents frequently are in need of both reliable portable lighting as well as a beacon to warn motorists or others approaching the location.

An additional need for first responders is for personal safety. Entering a possible crime location, fire or other incident, first responders such as firemen and police are in need of the ability to provide their position to others who might follow their arrival at an incident site. Firemen, police, security personnel and other first responders can become lost or trapped or injured at the very location to which they have been dispatched to help. Such first responders as police and security personnel in addition, can become victims of criminal behavior or even hostages.

It is therefor advantageous that such first responders and even common citizens have an emergency device that provides light as needed. A further need is the ability to provide a tracking signal or beacon to third parties regarding the location of the person carrying the device which is passive or may be initiated by the user manually. Still further, for such first responders, it is advantageous if the device can not only broadcast a locating signal, but also optionally a message that may be discerned by other first responders.

In cases where first responders are security related it is especially advantageous if the broadcast component of the device is able to do so surreptitiously. This hidden communication ability will provide first responders in trouble, due to criminal activity, the ability to send a hidden message to subsequent responders of not only their location, but optionally elements of their current situation.

Further, in the circumstances where an individual was to have a physical health problem such as a heart attack, to pass out, or be a victim of a gunshot or other injury, or is otherwise incapacitated, some means for automatic signaling to subsequent responders to broadcast the condition of the individual or their specific location would be most helpful.

As such, there is an unmet need for a multi-functional emergency device that provides the user with a plurality of functions during an emergency situation. Such a device should provide a means for illumination of the surroundings of the user. Such a device should be adapted to alert third parties to the presence of the user in situations such as on a dark roadway. Such a device should be able to passively monitor the user's location, and provide a beacon should subsequent first responders be required to aid the user. Finally, such a device should provide for communication from the user to subsequent first responders in a fashion that is not easily detected by others proximate to the user. This communication should be either be preprogrammed, or optionally initiated and customized by the user in real time to allow the user to send customized messages as to their current predicament if needed and do so without being discovered.

SUMMARY OF THE INVENTION

The device as herein disclosed and describe provides a multi-functional device which is both a flashlight as well as a beacon and personal location device for subsequent responders. Formed in the shape of a conventional flashlight, the device employees a plurality of means for broadcast of location and situational elements of the user.

The device employs a housing formed of one or a combination of metal such as aluminum, plastic or a composite material. Power for the device would be provided by batteries preferably with a high power to weight ratio to make the device lighter such as rechargeable lithium ion batteries and/or rechargeable lithium polymer batteries and/or lithium thionyl chloride batteries and/or alkaline batteries.

In order to maximize illumination by the device for the longest period of time, the means for illumination for the flashlight portion would be preferably a high intensity LED. However, an incandescent flashlight bulb may also be employed.

Due to the nature of use of the device, in storms and possible wet environments, the casing should be sealed to be substantially waterproof or water resistant. All switches and controls should be equally resistant to the harsh environment likely to be encountered. These switches would control the activation of the flashlight, and the optional user-controlled beacon and communications functions.

Means for communicating the user's location to responders looking for the user, may preferably be provided in a number of modes to provide multiple backups and options to communicate the location and situation of the user. A first means for such communication and alert function is provided by a flasher which may be visible and engaged to the casing. A second, and preferred in the current mode of the device, is a non-visible means for light-based communication, such as an infrared light such as that is provided by an infrared LED. Light transmitted by the LED cannot be seen by the naked eye, but is highly visible with viewing equipment adapted to communicate light in this spectrum. Consequently, subsequent responders with night-vision goggles, eye wear, or cameras adapted to see infrared light will easily ascertain the location of the user. Infrared light will communicate through windows and cracks under doors and even through roof vents and consequently, subsequent responders looking for the user, will be able to ascertain their location inside a building if there is even minimal communication there from of the infrared signal.

Also provided, alone or in combination with, the infrared broadcast means noted above can be an RFID based transmitter which may be programmed with certain information identifying the device which can be cross referenced to identify the user. Such RFID transmitters can be passive in nature such that they only respond when they receive a signal to broadcast, or when energized by a field sufficiently proximate to the RFID.

Also optionally included, singularly or in combination with the infrared emitter and/or the RFID transmitter, would be a means for ascertaining the location of the device geographically. Such a means can be a GPS locator that employs satellites, or more preferably a locator based on cellular telephone signals. The cellular mode is preferred because GPS will not generally work inside of a structure, while cellular triangulation will function since the cellular signals are adapted to penetrate structures. The cellular locator device may also be adapted to respond electronically to a signal broadcast to the device which would be adapted to cause such a response. The response may be either a broadcast of a device identifier to the cell tower, and/or initiation of the infrared transmitter to emit a signal.

An antenna adapted to receive and/or transmit in one or a combination of RF communication modes such as CDMA, GSM, GPRS, or other RF bands would be provided. If internally mounted inside the casing, the casing would best be formed of a composite that would not inhibit the signal from reaching or transmitting from the antenna. A processor with memory placed onboard would have software and circuitry adapted to provide one or two way communications in the mode of communication chosen be it RF or light based or both. The antenna may also be adapted to receive a satellite based GPS signal for communication to the processor or a separate antenna may be provided.

In one preferred mode an optional removably engageable magnetic sleeve adapted for circumferential engagement of the casing may be provided for easy mounting of the device to any metal surface.

Switches are provided to allow the user to initiate the flashlight, and/or the visible beacon, and/or the infrared transmitter, and/or an RF transmitter. A switch may also be provided to allow the user to initiate real time communication using the infrared transmitter, or to initiate a preprogrammed communication stored in memory on the device whereby the infrared transmitter would send a looped communication that may be read by receivers adapted to view and decipher the signal transmitted. Thus, an injured user might activate the device to send an, "I'm injured" signal, or a user being held captive may press the switch in a manner to activate a preprogrammed signal transmitting that fact to subsequent responders who will have equipment adapted to see and decipher the infrared signal. Persons proximate to the user would be unable to see the signal and therefor be unaware of it.

Employed in an emergency, the user of the device, herein for instance, may activate a switch to initiate the processor to perform a search for satellites and cell towers. When the processor with CDMA/GSM/GPRS/GPS ability acquires the network of satellites and/or cell towers, an automatic location signal may be transmitted through the cellular network. The location signal would be a request to capture a time synchronized "snap shot" of the user's terrestrial location using the GPS coordinates and/or cellular tower coordinates that are quickly processed to accurately calculate the location of the device.

Once ascertained, the terrestrial location or "location point" of the device may be prominently displayed to third parties monitoring the user via an internet capable computer and monitor or a hand held internet capable cell phone with display monitor. The "location point" of the device identified with a user is displayed for viewing onto digital street mapping and or satellite imagery for familiar landmark recognition for others to ascertain the location or the user using a cell phone or PDA adapted to receive the location point signal.

There are several ways to operate the device. The user may initiate a search and rescue operation and activate the life saving terrestrial locator features by depressing and/or sliding a switch adapted to initiate this function. This "locate me now" command is a distress signal sent to a pre-authorized designated entity in the form of a text message, email and or fax. Authorized user(s) with an internet capable computer, correct login credentials which allow access to the tracking application account assigned to the identified device may thereafter initiate a single location or tracking operation.

Law Enforcement personnel carrying a device having an identifier, which may be broadcast and associated with the user in an emergency, can be pre-authorized to access the tracking application account to perform an emergency location of the holder of the device. This would allow civilians or other non-responders to have a device, or other law enforcement personnel, and to be tracked or located by authorized law enforcement personnel.

The switches are mounted for activation external to the housing of the device and initiate a number of functions alone or in combination. A first switch is provided to activate the flashlight function. A second switch may be provided for activating the emergency command to "locate me now" with GPS technology or cellular assisted GPS technology. Other switches may be provided to initiate the infrared transmitter or to initiate broadcasts by the RFID technology.

The infrared transmitter would be a light or LED or other means, to emit infrared light and will function as an invisible strobe flasher that cannot be seen by the naked eye in day or night. The IR flasher can only be seen by infrared optical technology such as a pair of infrared binoculars or an infrared monocular device. It may function as a blinker or constant light as a beacon, or may transmit messages in a format that may be read by devices adapted to receive and ascertain the transmitted message.

The RFID chipset may function alone or in combination with the radio and infrared transmitters as an additional locator feature should the infrared transmission be undetectable, and should the CDMA/GSM/GPRS/GPS chipset be unable to be located accurately. The RFID component may be separately powered by a separate battery or the main battery and may have its own separate antenna if required.

In an example of use of the device, a law enforcement officer investigating a crime while using the device as a flashlight may suddenly be in a life threatening situation. By pressing the switch on the device it becomes an emergency location device which immediately alerts the designated command center that an officer has an emergency and needs help. The command center locates the officer using the tracking application in a matter of seconds and dispatches help to the officer's location.

Upon arriving, subsequent responders may employ a viewing device to see and receive communications from the infrared emitter, which acts as a failsafe location solution in the case where the distressed officer is inside a building and the GPS coordinates or the assisted GPS coordinates are not as accurate. Officers arriving on the scene may use infrared viewing devices to locate the officer with pinpoint accuracy indoors or outdoors. The RFID component functions as another failsafe locator solution when the infrared transmitter can't be detected and the GPS coordinates or the assisted GPS coordinates are not as accurate.

The infrared emitter and locator feature and RFID transmitter and locator feature are designed as back-up locator features when ascertaining the location by GPS or cellular triangulation fails. Further, the infrared transmitter in the most preferred mode of the device will be adapted to transmit one or both of preprogrammed messages, or real time messages such as by morse code.

In an example a police officer may be in a remote area with weak cellular signal strength and there are no buildings or landmarks to use as a reference for the officers location. The infrared transmitter and RFID device may perform independently from the GPS locator and assist the responding officers in locating the distressed officer who has activated the emergency GPS locator, IR flasher and RFID simultaneously on his or her device by pressing the appropriate activation button. The multiple transmission may also be activated by a radio signal received by the device should the officer be incapacitated.

In another example, the device might be employed as a tracking beacon by an officer during a common traffic stop. The officer might drop his device in a planned accidental move. The device may then be engaged to the car using the optional magnetic sleeve that can be easily and quickly-mounted on the device. With the device thereby securely mounted under the criminal's car, law enforcement has a safe and effective means for covertly performing tracking surveillance. The criminal would simply think the officer dropped and picked up his flashlight.

It is thus an object of this invention to provide an emergency beacon in combination with a flashlight.

It is a further object of this invention to provide such an emergency beacon having a plurality of means for self-ascertaining its location.

It is a further object of this invention to provide such a device which provides for invisible light based communication as a beacon to responders.

It is yet a further object of this invention to provide for invisible light-based communication and messaging to allow responders looking for an individual to ascertain both their location and situational information based on the communication.

With respect to the above description and background, before explaining at least one preferred embodiment of the invention in detail, it is to be understood that the invention is not limited in its application to the details of construction and to the arrangement of the components and/or steps set forth in the following description or illustrated in the drawings. The various apparatus and methods of the invention herein described and disclosed are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for the designing of other devices, methods and systems for carrying out the several purposes of the present disclosed device, combining a flashlight with location and beacon broadcasting abilities. It is important, therefore, that the objects and claims be regarded as, including such equivalent construction and methodology, insofar as they do not depart from the spirit and scope of the present invention.

DETAILED DESCRIPTION OF PREFERRED EMBODIMENTS

Figure 1:
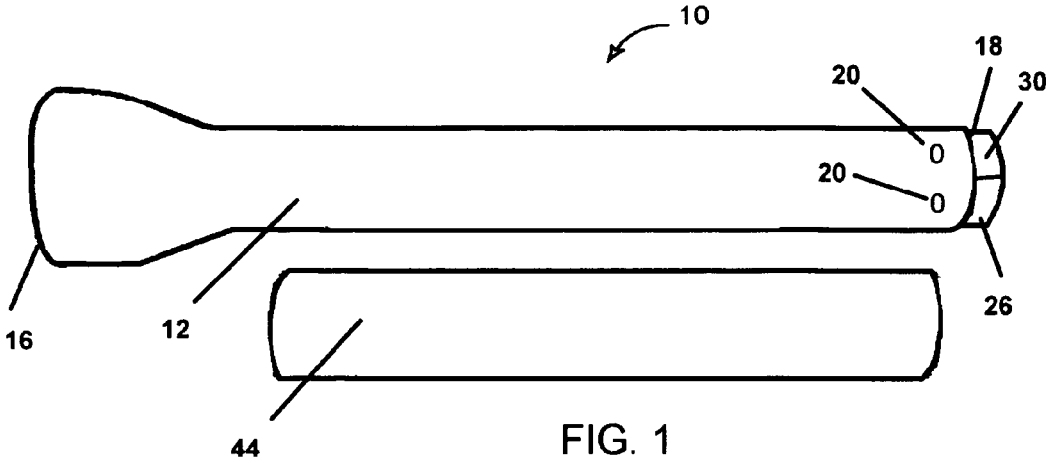
FIG. 1 depicts the exterior of the device housing showing switches to initiate the beacon and other communications functions and the optional magnetic sleeve.
Figure 2:
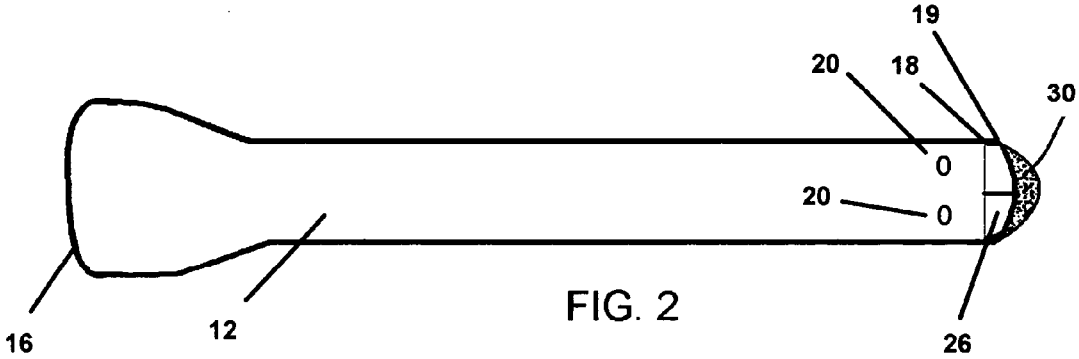
FIG. 2 depicts the device with infrared transmission component at the rear end.
Figure 3:
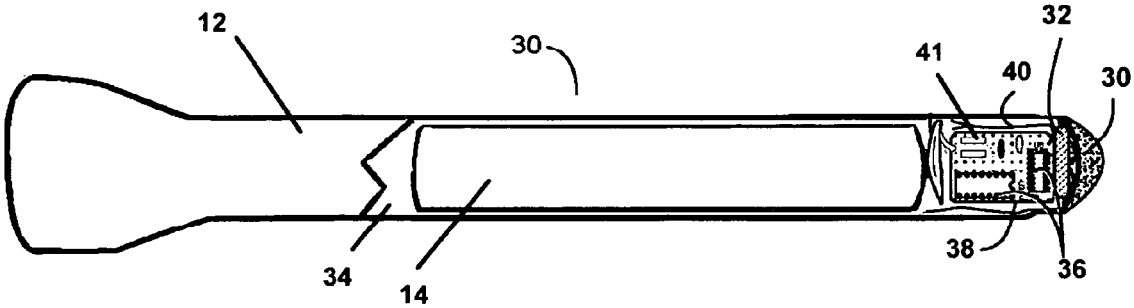
FIG. 3 is a sectional view through FIG. 3 showing the battery and internal data and communication components of the device.

Referring now to the drawings in FIGS. 1-3, wherein similar parts are identified by like reference numerals, the device 10 is depicted in FIG. 1 and shows the housing 12 formed of one or a combination of metal such as aluminum, plastic or a composite material in a fashion to allow radio communication to reach internal components. As shown in FIG. 3, a battery 14 which may be rechargeable provides electrical power to the components of the device 10.

At the first end, a means for illumination of the flashlight 16 component is provided which is preferably a high intensity LED or otherwise an incandescent flashlight bulb. Access to the interior is provided by a removable cap portion 19 in a sealed engagement 18 which may be at the front or rear of the housing 12 but is shown at the second or rear end in FIGS. 1 and 2.

One or preferably a plurality of switches 20 are user-accessible from the exterior of the housing 12. The switches control the activation of the flashlight 16, and the optional user-controlled beacon and communications functions.

A first means for communicating the position of the user is provided by a flasher 26 which may be on the housing 12 or the cap portion 19 and would be activated to blink and provide a visible beacon. A second light-based means to communicate the position of the device 10 in the preferred mode of the device is a non-visible means for light-based communication such as an infrared light 30 which also may be located on the cap portion 19 or elsewhere on the exterior of the housing 12. The infrared light 30 may simply blink, remain on constantly, or may be adapted to communicate messages to a receiver adapted to read and ascertain their content.

For use alone or in combination with the infrared broadcast means noted is an RFID based transmitter 32 adapted for mounting in the internal cavity 34 of the housing 12. The RFID transmitter 32 as noted may be programmed with certain information identifying the device which can be cross referenced to identify the user. It may be passive in nature such that it transmits a response when a signal to broadcast is communicated to it, or when energized by a electronic field sufficiently proximate to the RFID transmitter 32 to energize it in a conventional fashion.

Also optionally included singularly or in combination with the infrared light 30 and/or the RFID transmitter 32 is a means for ascertaining the location of the device 10. This function would be provided by the processor 36 and circuit board 38 having memory and software adapted to the task of receiving satellite or terrestrial based signals and triangulating a position on the earth therefrom.

A first antenna 40 adapted to receive and/or transmit in one or a combination of RF communication modes such as CDMA, GSM, GPRS, or other RF bands would be provided as part of or operatively engaged with the circuit board 38. An RF transmitter or transceiver 41 would provide means to receive and/or transmit radio communication signals from the device 10. The processor 36 might also be enabled to handle communications using software adapted to the task. The antenna 41 may also be adapted to receive a satellite based GPS signal for communication to the processor 36 for triangulation or a separate antenna may be provided.

In one preferred mode of the device, a removably engageable magnetic sleeve 44 adapted for circumferential engagement of the outside of the housing 12 may be provided for easy mounting of the device 10 to any metal surface. This sleeve 44 may be used to store the device 10 or engage it to something to track movement.

Switches 20 are adapted to initiate the flashlight 16, and/or the visible beacon provided by the flasher 26, and/or the infrared transmitter provided by infrared light 30, and/or the RF transceiver 41. A switch 20 may also be provided to allow the user to initiate real time communication using the infrared transmissions from the infrared light 30, or to initiate a preprogrammed communication stored in memory on the circuit board 38 whereby an infrared transmission in a continuous looped communication may be transmitted and read by receivers adapted to view and decipher the signal transmitted.

Figure 4:
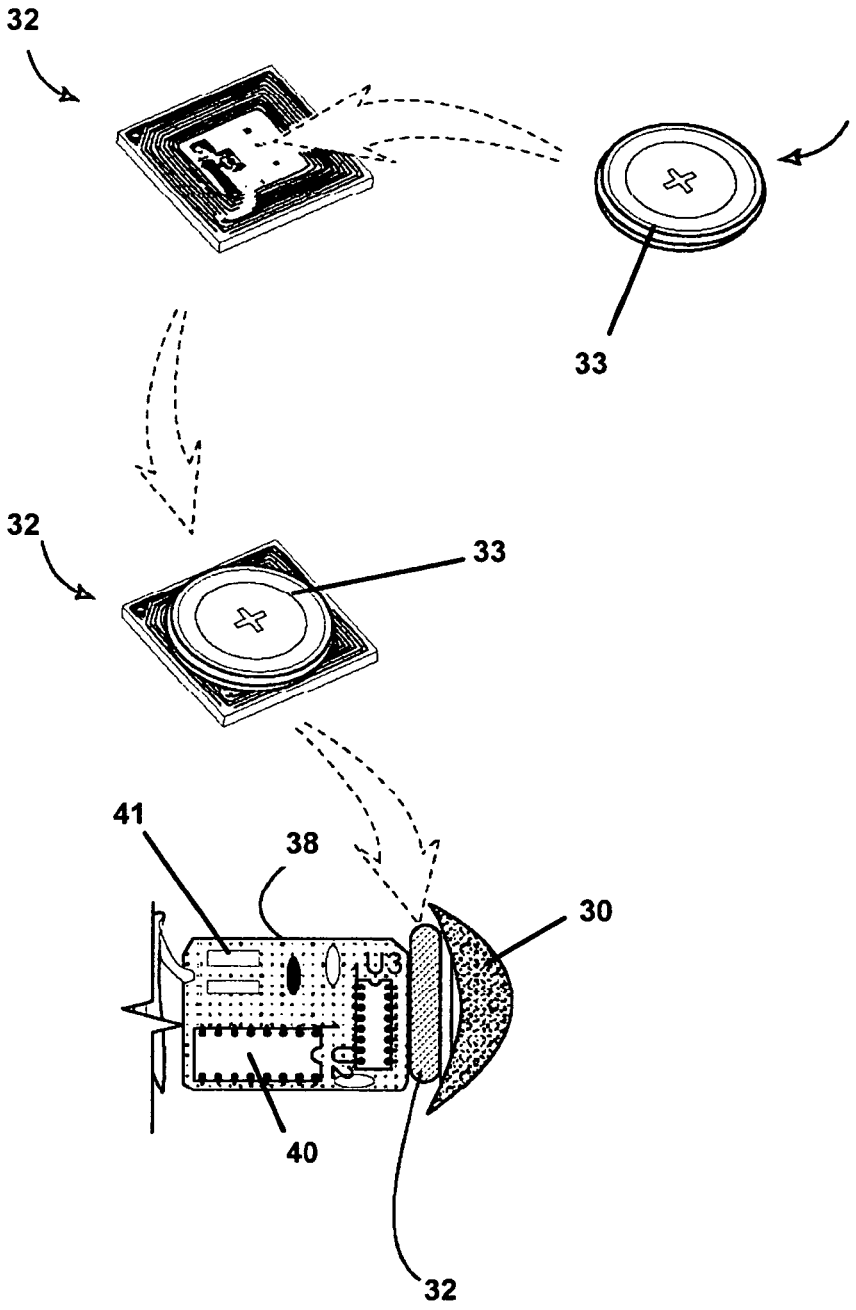
FIG. 4 shows the RFID component and optional second battery along with the internally housed circuit board and processor.

Additionally, as shown in FIG. 4, the RFID transmitter 32 may have a permanent, or rechargeable second battery 33 for powering the RFID which may transmit independently or in concert with the transceiver 41 based on communications received by the RFID transmitter 32. The second battery 33 ensures the RFID transmitter 32 will always work independent of the rest of the components of the device 10 should the battery become discharged.

Regarding the disclosed device 10, it is to be understood that elements of different construction and configuration and different steps and process procedures and other arrangements thereof, other than those illustrated and described, may be employed for providing the combination flashlight and emergency locator and communication device herein within the spirit of this invention.

As such, while the present invention has been described herein with reference to particular embodiments thereof, a latitude of modifications, various changes and substitutions are intended in the foregoing disclosure, and it will be appreciated that in some instance some features of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. A multi-function emergency apparatus comprising:

an housing having a first end and a second end and an internal cavity defined by a housing wall;

said internal cavity adapted to house a battery to power said emergency apparatus;

an illumination means activated by a first switch accessible upon an outside surface of said housing wall;

means to determine a terrestrial location of said emergency apparatus including one or a combination of a GPS location determining component and a secondary location determining component adapted to determine said terrestrial location from RF signals received from a plurality of cellular telephone towers;

means to communicate said terrestrial location once determined to a remote location; and a beacon for signaling the presence of said emergency apparatus at said terrestrial location, said beacon comprising one or a combination of an RFID, an infrared light emitter, and a visible light emitter.

2. The multi-function emergency apparatus of claim 1 additionally comprising:

said beacon including said infrared light emitter whereby light invisible to the human eye provides a light signal invisible to humans proximate to a user of said emergency apparatus thereby providing a secret beacon as to said terrestrial location.

3. The multi-function emergency apparatus of claim 2 additionally comprising:

a data processor; and said data processor encoding a message into said light signal;

said message decodable by a light signal reader, whereby said user transmits said message with said infrared light emitter.

4. The multi-function emergency apparatus of claim 3 additionally comprising:

said message stored in a memory engaged to said data processor; and a second switch changeable to an activated position to thereby initiate transmission of said message.

5. The multi-function emergency apparatus of claim 4 additionally comprising:

a sleeve having an interior axial passage adapted for engagement with said outside surface of said housing wall; and said sleeve being magnetic whereby said emergency apparatus engaged in said axial passage engaged to a magnetically attractive surface.

6. The multi-function emergency apparatus of claim 3 additionally comprising:

a sleeve having an interior axial passage adapted for engagement with said outside surface of said housing wall; and said sleeve being magnetic whereby said emergency apparatus engaged in said axial passage engaged to a magnetically attractive surface.

7. The multi-function emergency apparatus of claim 2 additionally comprising:

a sleeve having an interior axial passage adapted for engagement with said outside surface of said housing wall; and said sleeve being magnetic whereby said emergency apparatus engaged in said axial passage engaged to a magnetically attractive surface.

8. The multi-function emergency apparatus of claim 1 additionally comprising:

a sleeve having an interior axial passage adapted for engagement with said outside surface of said housing wall; and said sleeve being magnetic whereby said emergency apparatus engaged in said axial passage engaged to a magnetically attractive surface.

9. A multi-function emergency apparatus comprising:

a housing having a first end and a second end and an internal cavity defined by a housing wall;

said internal cavity adapted to house a battery to power said emergency apparatus;

an illumination means activated by a first switch accessible upon an outside surface of said housing wall;

a data processor having electronic memory operatively engaged to adjust said invisible signal to communicate a message;

means to activate said data processor to communicate said message in said invisible signal;

said infrared viewer engaged to a signal reading component adapted to decipher said message;

means to electronically determine a terrestrial location of said emergency apparatus from either GPS signal broadcast by a plurality of satellites, or from a plurality of radio signals broadcast from a plurality of terrestrial locations;

a beacon for emitting an invisible signal identifying the presence of said emergency apparatus at a terrestrial location, said beacon comprising an infrared light emitter, whereby said emergency apparatus and a user thereof located at said terrestrial location using an infrared viewer adapted to display said invisible signal to a human eye; and means to communicate said terrestrial location once determined, to a remote location, whereby said terrestrial location of a user employing said emergency apparatus remotely determined and relayed to responders who can locate said user by employing an infrared viewer capable of depicting said invisible signal and following said invisible signal emitted by said beacon from a position where said invisible signal is viewable.

10. The multi-function emergency apparatus of claim 9 additionally comprising:

a data processor having electronic memory operatively engaged to adjust said invisible signal to communicate a message;

means to activate said data processor to communicate said message in said invisible signal; and said infrared viewer engaged to a signal reading component adapted to decipher said message whereby a message regarding a status of said user secretly communicated to said responder.

11. The multi-function emergency apparatus of claim 9 additionally comprising:

said means to communicate said terrestrial location once determined to a remote location, being a transceiver.

12. The multi-function emergency apparatus of claim 9 additionally comprising:

an RFID, said RFID activated to transmit an RF signal by a communication from said data processor or an RF field, said RF signal acting as a secondary beacon.

* * * * *